US007018277B2

(12) United States Patent
Gegenheimer

(10) Patent No.: US 7,018,277 B2
(45) Date of Patent: Mar. 28, 2006

(54) DEVICE FOR GRINDING WORKPIECES

(75) Inventor: Helmut Gegenheimer, Keltern (DE)

(73) Assignee: Otec Prazisionsfinish GmbH, Straubenhardt-Feldrennach (DE)

( * ) Notice: Subject to any disclaimer, the term of this patent is extended or adjusted under 35 U.S.C. 154(b) by 0 days.

(21) Appl. No.: 10/705,971

(22) Filed: Nov. 13, 2003

(65) Prior Publication Data

US 2004/0185759 A1 Sep. 23, 2004

(30) Foreign Application Priority Data

Nov. 18, 2002 (DE) ..... 102 53 833

(51) Int. Cl.
*B24B 31/108* (2006.01)

(52) U.S. Cl. ..... 451/328; 451/113

(58) Field of Classification Search ..... 451/328, 451/327, 326, 104, 113, 32
See application file for complete search history.

(56) References Cited

U.S. PATENT DOCUMENTS

| | | | | |
|---|---|---|---|---|
| 607,368 | A * | 7/1898 | Hathorn | 451/327 |
| 2,813,376 | A * | 11/1957 | Middlemark | 451/67 |
| 4,830,289 | A * | 5/1989 | Umeya et al. | 241/57 |
| 4,850,151 | A * | 7/1989 | Ditscherlein | 451/327 |
| 4,958,776 | A * | 9/1990 | Walther | 241/171 |
| 5,088,238 | A * | 2/1992 | Lin | 451/113 |

FOREIGN PATENT DOCUMENTS

| | | |
|---|---|---|
| DE | 33 32 787 | 3/1985 |
| DE | 34 23 675 | 1/1986 |
| DE | 38 01 447 A1 | 8/1989 |

* cited by examiner

*Primary Examiner*—Robert A. Rose
(74) *Attorney, Agent, or Firm*—Antonelli, Terry, Stout and Kraus, LLP.

(57) ABSTRACT

To improve the grinding action when grinding workpieces in a device equipped with a container and a rotary disk rotating relative thereto using abrasive granules, according to the invention there are ribs in the upper area of the container.

24 Claims, 4 Drawing Sheets

DEVICE FOR GRINDING WORKPIECES

FIELD OF THE INVENTION

The invention relates to a device for grinding workpieces by means of abrasive granules, having a stationary container and a disk rotating therein, as well as a top part for the container of a device for grinding workpieces by means of abrasive granules, the device having a disk rotating relative to the container.

BACKGROUND OF THE INVENTION

Devices according to the prior art, disk grinding machines, are known, which have an upper area of the stationary container of the device, optionally constructed as a separate top part, which tapers from bottom to top, so that the upper opening of the container has a smaller diameter than the maximum internal diameter of the container.

Devices are also known having ribs with an exclusively vertical and optionally radial extension component. For an effective, rapid working of a workpiece, it is important to have maximum speed differences within the toroidal movement. If the wall friction on the container wall is equal to zero, the workpieces and granules move in accordance with the disk movement solely in a circle and without a significant relative movement. No working of the workpieces occur, because all the parts move in a circle with substantially the same speed. This leads to a low abrading capacity and therefore to a relatively long working period for grinding the workpieces. It has also been found that an increase in the abrading capacity cannot be brought about by increasing the rotational speed of the disk above a certain level, because in the vicinity of the disk slip, which increases with the rotational speed, occurs between the disk and the particles of the abrasive mixture, so that a rotational speed rise does not lead to a higher speed of motion of the abrasive mixture.

Therefore the problem of the invention is to avoid the aforementioned disadvantages and provide an improved grinding capacity and faster working possibilities for workpieces.

SUMMARY OF THE INVENTION

In the case of a device for grinding workpieces by means of abrasive granules of the aforementioned type, the invention solves the set problem in that in the upper area of the container there are ribs with at least one extension component in the rotation direction of the disk. A top part for a corresponding grinding device is constructed for solving the problem in the indicated way.

As a result of the ribs according to the invention with an extension component in the circumferential direction, the particles of the abrasive mixture are guided in a more planned manner and consequently are moved more rapidly, particularly inwards towards the centre of the container, so that their residence time along the container wall is reduced. The frequency of the movement of the particles (toroidal movement) from the disk over the container wall and back again close to the centre to the disk is increased and defined. This leads to a higher abrasive capacity and therefore to a faster working of the workpieces to be ground. It has also surprisingly been found that in the case of a workpiece grinding device in accordance with the invention, the increase in the disk rotational speeds further increases the grinding capacity in the rotational speed ranges, where this is no longer the case in the prior art.

According to a preferred development of the invention, the ribs at least also have a vertical extension component. According to another development the ribs are accurate. The ribs preferably have an inwardly directed edge.

Another preferred development is characterized in that adjacent ribs enter a common, concave edge and in addition the ribs are substantially triangular in cross-section. In a further construction according to the invention the area of the container having the ribs tapers away.

According to a preferred development, an upper part of the container carrying the ribs is rotatable relative to the rest of the container or can be connected in rotary manner with a residual container of the grinding device, the rotational speed differing from that of the disk.

BRIEF DESCRIPTION OF THE DRAWINGS

Further advantages and features of the invention can be gathered from the claims and description of an embodiment of the invention and with reference to the attached drawings, wherein show:

DETAILED DESCRIPTION OF THE DRAWINGS

Figure 1:
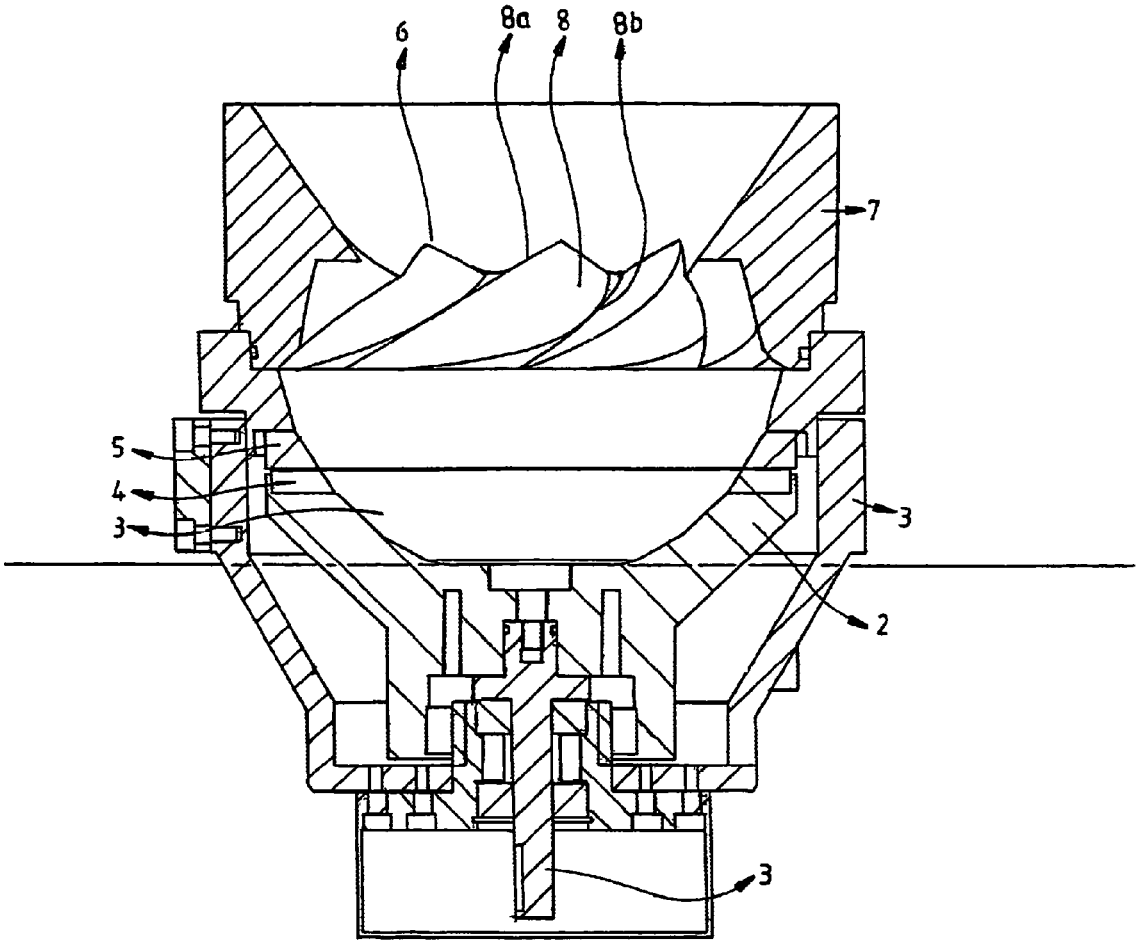
FIG. 1 A vertical longitudinal section through a workpiece grinding device according to the invention.

A device according to the invention for grinding workpieces by means of abrasive granules has in the represented embodiment a stationary container 1 in which a disk 2 can be rotated by means of a pivot 3 and on which acts a not shown drive. The disk 2 has a concave, inner surface 3. Both the container 1 and the disk 2 are provided on mutually facing front faces with at least a horizontal extension component with ceramic rings 4, 5 or plastic rings. The inventive container 1 has an upwardly and radially inwardly tapering upper area 6. In the embodiment shown, this area is constructed in an attachment 7 of the container 1, which is firmly joined to said container. The upper container area 6 is provided in its circumference with ribs 8, which extend from the bottom outside to the top inside and consequently also in the embodiment shown has both vertical and horizontal extension components. The ribs 8 have in each case an inner edge 8*a* and adjacent ribs are in contact with one another in a further outwardly located concave edge 8*b*.

Figure 2:
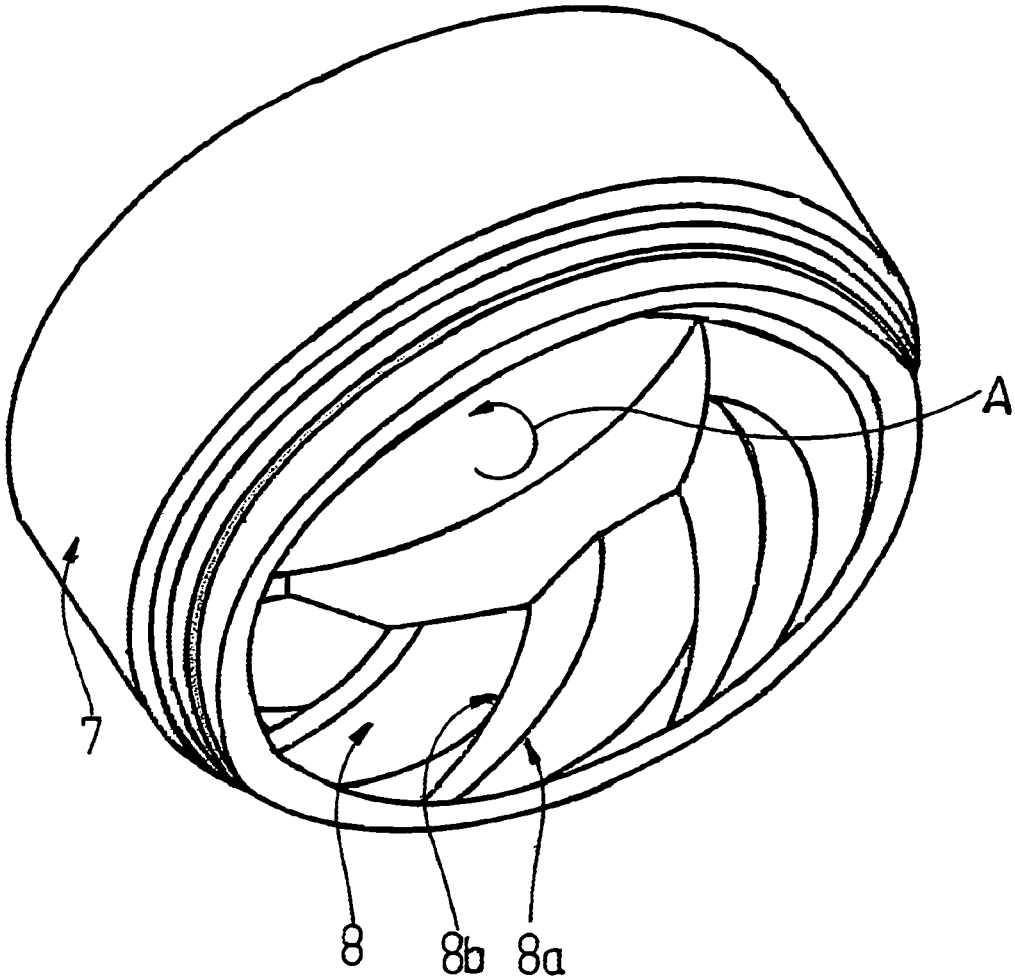
FIG. 2 A perspective view of an upper part of the container provided with ribs according to the invention.
Figure 3:
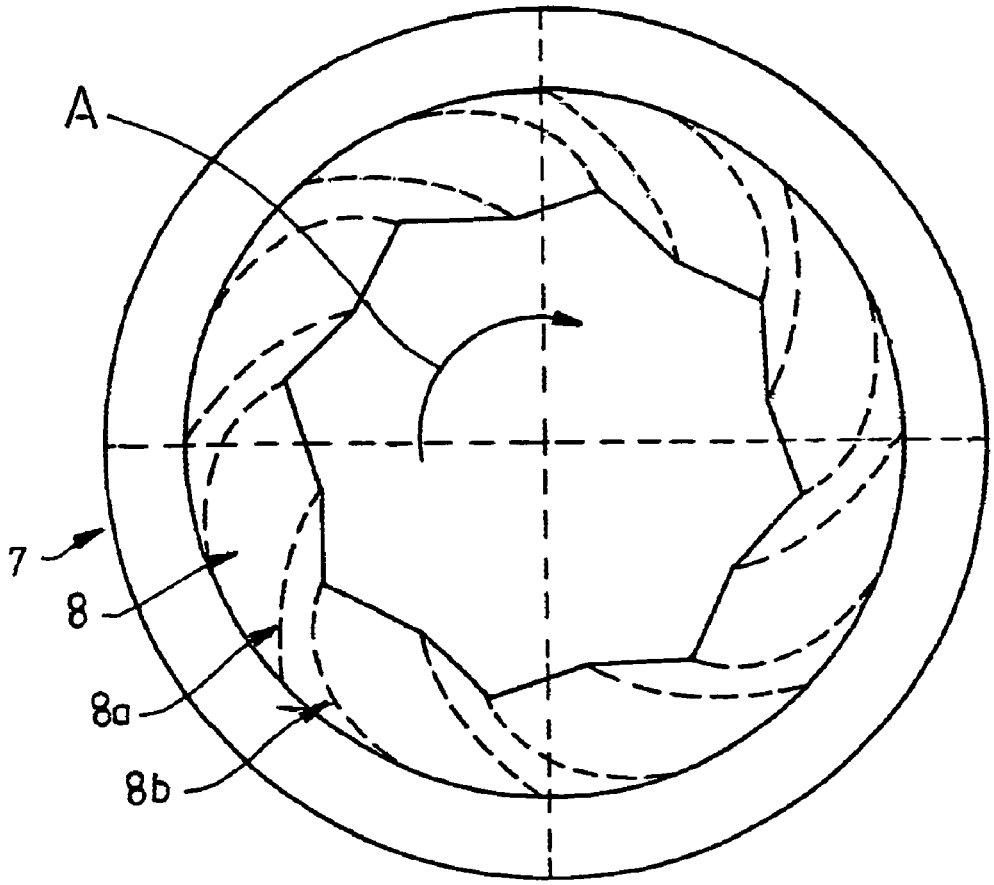
FIG. 3 A view from above of the workpiece grinding device according to the invention with ribs illustrated in broken line form and which are invisible in plan view.
Figure 4:
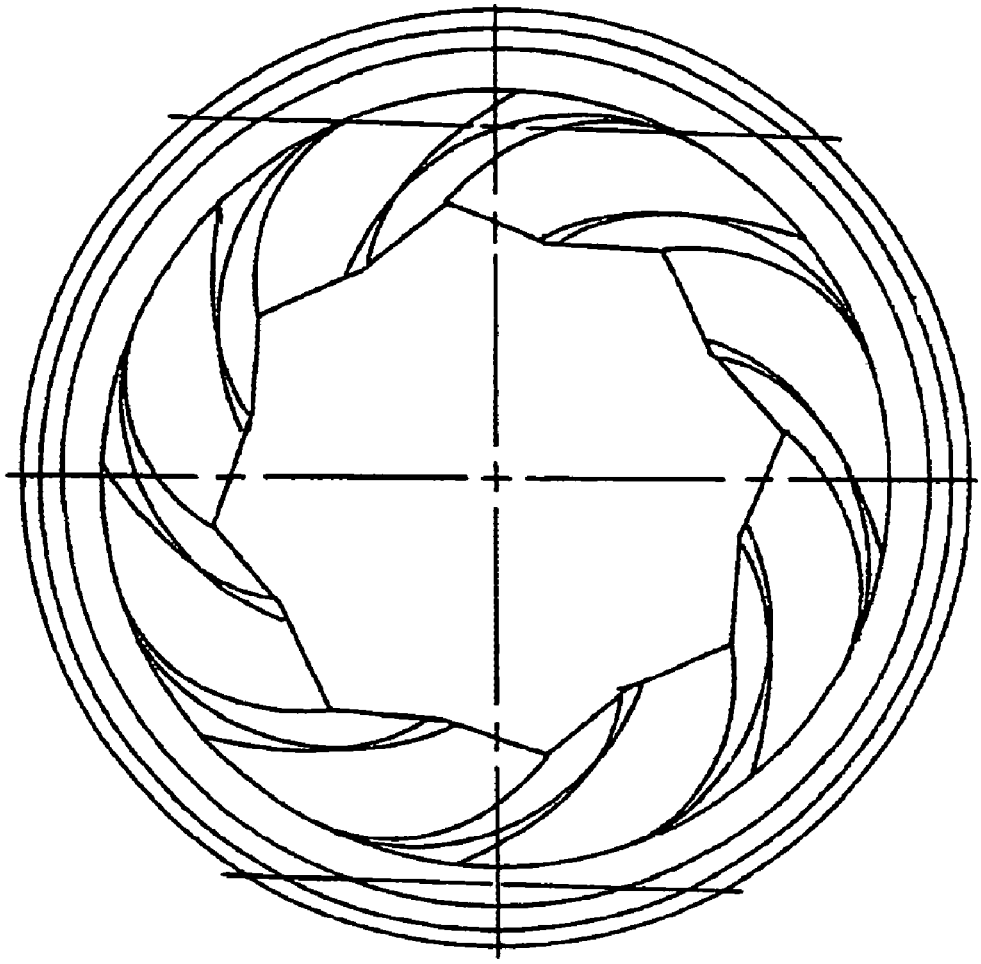
FIG. 4 A view from below of the upper part of the container of the workpiece grinding device according to the invention and as shown in FIGS. 2 and 3.

The ribs are accurate and run accurately from the outside to the inside in clockwise manner in a plan view of the container and therefore corresponding to the clockwise rotary movement A of the disk 2 (FIGS. 2 and 3).

Through the construction of the upper area 6 of the container 1 with the ribs 8 according to the invention the abrasive mixture containing the abrasive granules which is driven upwards and outwards along the wall of the container 1 as a result of the rotary movement of the disk 2, is guided in the upper area 8 of the container 1 along the ribs inwards or towards the centre of the container and consequently in an area above the disk 2 drops onto the disk 2 in a substantially central area. This reduces the residence time along the container wall of upwardly driven abrasive mixture in the vicinity of the stationary container and the abrasive mixture more rapidly drops down again onto the rotary disk, so that there is a much higher abrasive capacity compared with the known, solely upwardly tapering upper areas of grinding machines, so that faster working is achieved. In addition, the inventive grinding device can operate with much higher disk rotational speeds than has hitherto been the case.

What is claimed is:

1. Device for grinding workpieces by means of abrasive granules, having a container and a disk rotating relative to the container, wherein in an upwardly and radially inwardly tapering upper area of the container are provided ribs having at least one extension component in the rotation direction of the disk as well as at least one vertical extension component, the ribs being arranged to guide the abrasive granules along the rib inwardly towards a center of the container.

2. Device for grinding workpieces by means of abrasive granules, having a container and a disk rotating relative to the container, wherein in an upper area of the container are provided ribs with at least one extension component in the rotation direction of the disk, wherein adjacent ribs enter a common concave edge.

3. Device according to claim 2, wherein the ribs at least also have a vertical extension component.

4. Device according to claim 1, wherein the ribs are arcuate.

5. Device according to claim 1, wherein the ribs have an edge directed inwardly towards the center of the container.

6. Device according to claim 2, wherein the area of the container having the ribs tapers away.

7. Device according to claim 1, wherein the ribs are substantially triangular in cross-section.

8. Device according to claim 1, wherein a top part of the container carrying the ribs is rotatable relative to the remaining container.

9. Top part for a container having ribs at least in a partial area of a device for grinding workpieces by means of abrasive granules, the device having a disk rotating relative to the container, wherein in an upper area of the container there are ribs having at least one extension component in the rotation direction of the disk as well as at least one vertical extension component, the ribs being arranged to guide the abrasive granules along the rib inwardly towards a center of the container.

10. Top part for a container having ribs at least in a partial area of a device for grinding workpieces by means of abrasive granules, the device having a disk rotating relative to the container, wherein in an upper area of the container there are ribs with at least one extension component in the rotation direction of the disk, wherein adjacent ribs enter a common, concave edge.

11. Top part according to claim 10, wherein the ribs have at least one vertical extension component.

12. Top part according to claims 9, wherein the ribs are arcuate.

13. Top part according to claim 9, wherein the ribs have an edge directed inwardly towards the center of the container.

14. Top part according to claim 9, wherein the ribs are substantially triangular in cross-section.

15. Top part according to claim 10, wherein the area of the container having the ribs tapers away.

16. Top part according to claim 9, wherein said top part is adapted to be connected in rotary manner with a residual container of the grinding device.

17. Top part according to claims 10, wherein the ribs are arcuate.

18. Top part according to claim 10, wherein the ribs have an edge directed inwardly towards the center of the container.

19. Top part according to claim 10, wherein the ribs are substantially triangular in cross-section.

20. Top part according to claim 10, wherein said top part is adapted to be connected in rotary manner with a residual container of the grinding device.

21. Device according to claim 2, wherein the ribs are arcuate.

22. Device according to claim 2, wherein the ribs have an edge directed inwardly towards the center of the container.

23. Device according to claim 2, wherein the ribs are substantially triangular in cross-section.

24. Device according to claim 2, wherein a top part of the container carrying the ribs is rotatable relative to the remaining container.

* * * * *